US010072648B2

(12) United States Patent
Ogawa et al.

(10) Patent No.: US 10,072,648 B2
(45) Date of Patent: Sep. 11, 2018

(54) VARIABLE DISPLACEMENT TYPE SWASH PLATE COMPRESSOR

(71) Applicant: KABUSHIKI KAISHA TOYOTA JIDOSHOKKI, Aichi (JP)

(72) Inventors: Hiromichi Ogawa, Aichi-ken (JP); Shinya Yamamoto, Aichi-ken (JP); Takahiro Suzuki, Aichi-ken (JP); Hiroyuki Kobayashi, Aichi-ken (JP); Yusuke Yamazaki, Aichi-ken (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 174 days.

(21) Appl. No.: 15/355,914

(22) Filed: Nov. 18, 2016

(65) Prior Publication Data

US 2017/0145996 A1 May 25, 2017

(30) Foreign Application Priority Data

Nov. 24, 2015 (JP) ..... 2015-228843

(51) Int. Cl.
*F04B 27/18* (2006.01)
*F04B 27/08* (2006.01)
*F04B 27/10* (2006.01)

(52) U.S. Cl.
CPC ..... *F04B 27/1804* (2013.01); *F04B 27/0878* (2013.01); *F04B 27/0891* (2013.01); *F04B 27/1045* (2013.01); *F04B 27/1054* (2013.01); *F04B 27/1063* (2013.01); *F04B 27/1072* (2013.01); *F04B 27/18* (2013.01)

(58) Field of Classification Search
CPC .. F04B 27/0878; F04B 27/0891; F04B 27/10; F04B 27/12; F04B 27/14; F04B 27/16; F04B 27/18; F04B 27/1045; F04B 27/1054; F04B 27/1063; F04B 27/1072; F04B 27/1804; F04B 2027/1813; F04B 2027/1822; F04B 2027/1831
USPC ..... 417/222.1, 222.2, 269, 270; 92/12.2, 13, 92/71
See application file for complete search history.

(56) References Cited

U.S. PATENT DOCUMENTS 7,802,512 B2 * 9/2010 Lee ..... F01B 3/007 92/12.2
2004/0007126 A1 * 1/2004 Parsch ..... F01B 3/0023 92/13
2014/0294612 A1 * 10/2014 Suzuki ..... F04B 1/295 417/222.2

FOREIGN PATENT DOCUMENTS

JP 2014-190265 10/2014

* cited by examiner

*Primary Examiner* — Kenneth J Hansen
*Assistant Examiner* — Chirag Jariwala
(74) *Attorney, Agent, or Firm* — Greenblum & Bernstein, P.L.C.

(57) ABSTRACT

In a variable displacement type swash plate compressor, a connecting mechanism that connects a movable body and a swash plate includes a first arm having a first guide surface and a second arm having a second guide surface. The first and second arms extend from the movable body toward the swash plate and disposed on opposite sides of an imaginary plane that is defined to extend passing through a top dead center portion and an axis of rotation. The first arm and the second arm have a first opening and a second opening, respectively, that are open in a direction opposite to a direction in which a link pin moves on the first guide surface and the second guide surface with an increase of the inclination angle of the swash plate.

5 Claims, 10 Drawing Sheets

VARIABLE DISPLACEMENT TYPE SWASH PLATE COMPRESSOR

BACKGROUND OF THE INVENTION

The present invention relates to a variable displacement type swash plate compressor.

Japanese Unexamined Patent Application Publication No. 2014-190265 discloses a conventional variable displacement type swash plate compressor (hereinafter simply referred to as compressor). The compressor includes a housing, a drive shaft, a swash plate, a link mechanism and a plurality of pistons. The housing has therein a swash plate chamber and a plurality of cylinder bores. The drive shaft is rotatably supported in the housing. The swash plate is mounted on the drive shaft for rotation therewith in the swash plate chamber. The link mechanism is provided between the drive shaft and the swash plate and permits changing of an inclination angle of the swash plate relative to a direction perpendicular to the axis of rotation of the drive shaft. Each piston is received in its corresponding cylinder bore and reciprocally movable in the cylinder bore with a stroke length that is determined by the inclination angle of the swash plate thereby to form a compression chamber in the cylinder bore.

The compressor further includes a partitioning body, a movable body, a control chamber, and a control mechanism. The partitioning body and the movable body are disposed in the swash plate chamber and mounted on the drive shaft for rotation therewith. The movable body is movable relative to the partitioning body in the axial direction of the drive shaft so as to change the inclination angle of the swash plate. The control chamber is defined between the partitioning body and the movable body and causes the movable body to be moved with its internal pressure. The control mechanism controls the pressure in the control chamber.

The movable body is connected to the swash plate through the link mechanism. Specifically, the link mechanism includes a first arm and a second arm that are provided in the movable body, and a traction portion that is formed in the swash plate. The first and second arms extend toward the swash plate, and the traction portion projects toward the movable body in a space between the first and second arms.

The first arm has therethrough a circular first hole and the second arm has a circular second hole, respectively. The traction portion includes a pin having one end thereof inserted through the first hole and the other end thereof through the second hole, respectively.

The movement of the movable body away from the swash plate in the axial direction of the drive shaft by an increased pressure in the control chamber is transmitted through the first and second holes of the first and second arms and the link pin held by the traction portion. As a result, the movable body pulls the swash plate thereby to increase the inclination angle of the swash plate.

According to the compressor disclosed in the Publication, the relative positional relation between the link pin and the first and second holes remains constant without being affected by the change of the inclination angle of the swash plate. In order to enhance the freedom of setting the pattern of changing of the inclination angle of the swash plate, it may be contemplated, for example, to form the first and second holes into elongated holes and to form a first guide surface that is contactable with the link pin on a side thereof opposite to the swash plate and a second guide surface that is contactable with the link pin on the side thereof opposite to the swash plate so that the link pin is disposed slidably and reciprocally on the first and second guide surfaces with the change of the inclination angle of the swash plate.

However, it is difficult for a compressor having such configuration to achieve both the efficient conversion of pulling force of the movable body into the change of the inclination angle of the swash plate and the enhancement of the smooth operation and the wear resistance of the movable body that rotates with the drive shaft.

In order for the movable body to change the inclination angle of the swash plate with a small force, it is preferable that the link pin on which the pulling force of the movable body acts should be spaced at a distance from the axis of rotation of the drive shaft. However, such position of the link pin involves an increase in the dimension of the first and second arms as measured in a direction separating from the axis of rotation and, therefore, the weight of the respective first and second arms tends to be increased locally at positions that are distant from the axis of rotation. As a result, the center of gravity of the movable body is shifted away from the axis of rotation and, therefore, the centrifugal force that acts on the movable body is increased to cause an irregular movement of the movable body, which hinders the enhancement of the smooth operation and the wear resistance of the movable body.

Meanwhile, in order to reduce the centrifugal force that acts on the movable body, the center of gravity of the movable body should preferably be located as close to the axis of rotation as possible. In this case, the link pin tends to be disposed close to the axis of rotation so as to reduce the weight of the first and second arms. As a result, a greater force may be required for the movable body to change the inclination angle of the swash plate, and the pulling force of the movable body may not be efficiently converted into the change of the inclination angle of the swash plate.

The present invention, which has been made in view of the above circumstances is directed to providing a variable displacement type swash plate compressor that achieves both the efficient conversion of the pulling force of the movable body into the change of the inclination angle of the swash plate and the enhancement of the smooth operation and the wear resistance of the movable body that rotates with the drive shaft.

SUMMARY OF THE INVENTION

In accordance with an aspect of the present invention, there is provided a variable displacement type swash plate compressor that includes a housing having therein a swash plate chamber and a plurality of cylinder bores, a drive shaft that is rotatably supported in the housing, a swash plate that is mounted on the drive shaft for rotation therewith in the swash plate chamber, a link mechanism that connects the drive shaft and the swash plate and permits changing of an inclination angle of the swash plate with respect to a direction perpendicular to an axis of rotation of the drive shaft, and a plurality of pistons that is received in the respective cylinder bores so as to form respective compression chambers and reciprocally movable with the rotation of the swash plate for a length of stroke determined by the inclination angle of the swash plate. The variable displacement type swash plate compressor further includes a partitioning body that is mounted on the drive shaft for rotation therewith in the swash plate chamber, a movable body that is mounted on the drive shaft for rotation therewith and movable relative to the partitioning body along the axis of rotation in the swash plate chamber to thereby change the inclination angle of the swash plate, a control chamber that is formed between the partitioning body and the movable body and causes the movable body to move with the internal pressure thereof, and a control mechanism that controls pressure in the control chamber. The movable body is connected with the swash plate through a connecting mechanism and pulling the swash plate to increase the inclination angle of the swash plate with an increase of the pressure in the control chamber. The swash plate has a top dead center portion that permits one of the pistons to be located at the top dead center. The connecting mechanism includes a first arm that is disposed on one side of an imaginary plane defined to extend passing through the top dead center portion and the axis of rotation and extends from the movable body toward the swash plate, a second arm that is disposed on the other side of the imaginary plane and extends from the movable body toward the swash plate, a traction portion that extends from the swash plate toward the movable body and is disposed between the first arm and the second arm, and a link pin that connects the traction portion to the first arm and the second arm. The first arm has a first guide surface that faces away from the swash plate and is in contact with the link pin, and a first facing portion that faces a first end of the link pin. The second arm has a second guide surface that faces away from the swash plate and is in contact with the link pin, and a second facing portion that faces a second end of the link pin. The first arm and the second arm have a first opening and a second opening, respectively, that are open in a direction opposite to a direction in which the link pin moves on the first guide surface and the second guide surface with an increase of the inclination angle of the swash plate.

Other aspects and advantages of the invention will become apparent from the following description, taken in conjunction with the accompanying drawings, illustrating by way of example the principles of the invention.

DETAILED DESCRIPTION OF THE EMBODIMENT

The following will describe a variable displacement type swash plate compressor according to an embodiment of the present invention with reference to the accompanying drawings.

Embodiment

Figure 1:
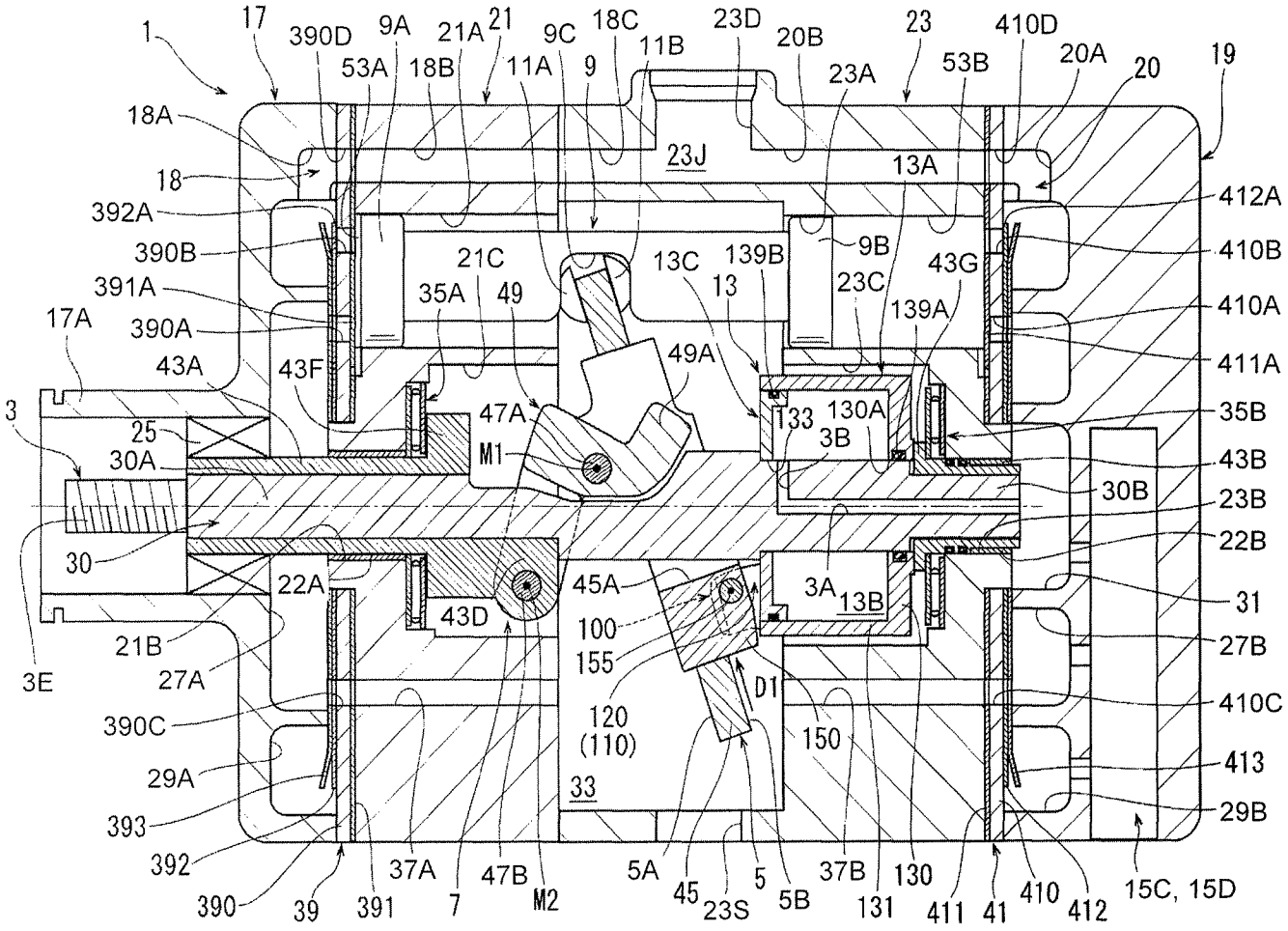
FIG. 1 is a longitudinal cross-sectional view of a compressor according to an embodiment of the present invention, showing a state of the compressor at its maximum displacement.
Figure 2:
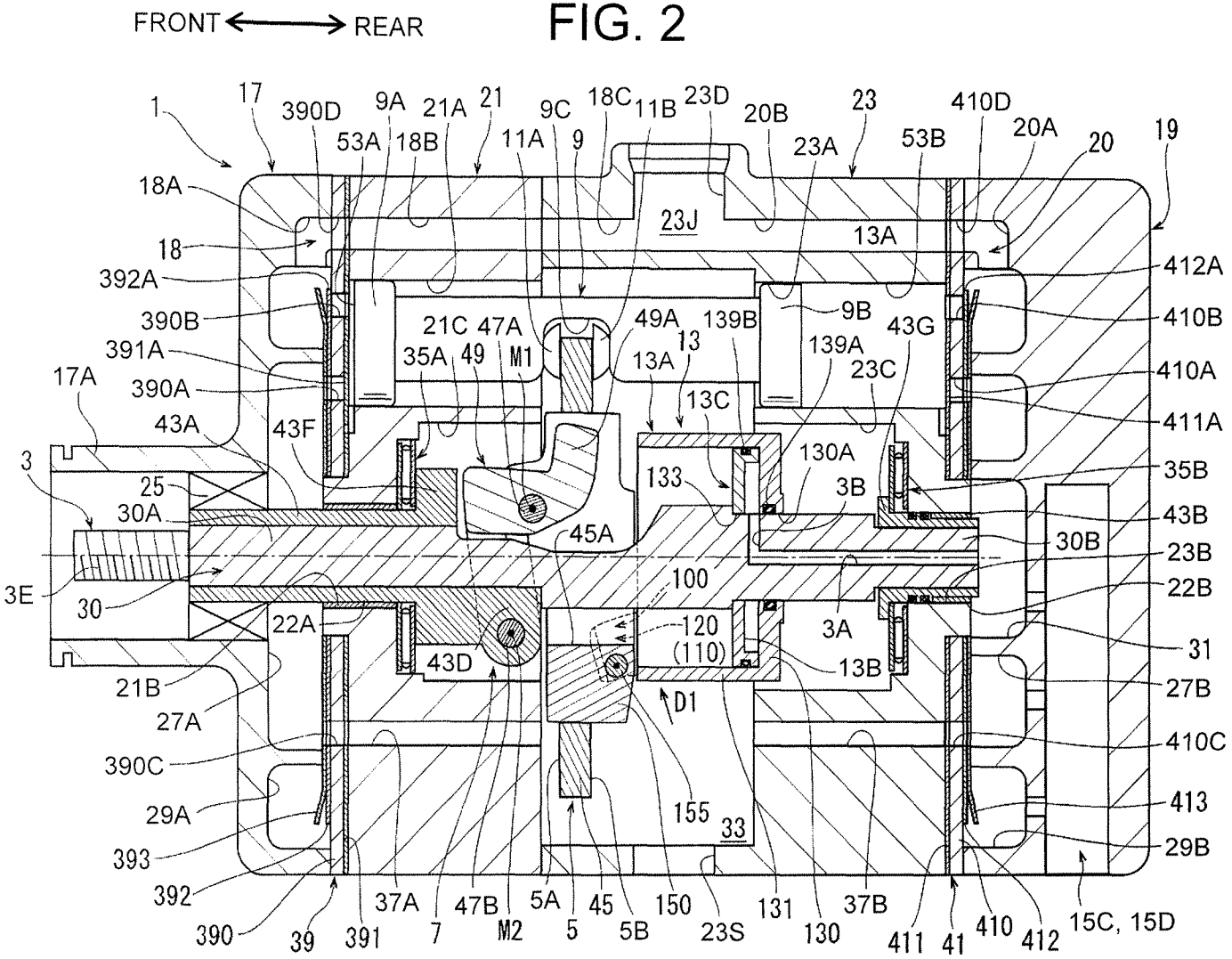
FIG. 2 is a longitudinal cross-sectional view of the compressor of FIG. 1, showing a state of the compressor in its minimum displacement.

Referring to FIGS. 1 and 2, there is shown a variable displacement type swash plate compressor (hereinafter simply referred to as the compressor) according to an embodiment of the present invention. The compressor according to the present embodiment employs a double-headed piston. The compressor is mounted on a vehicle and forms a part of a refrigeration circuit of an air conditioner of the vehicle. In FIGS. 1 and 2, the left side and right side of the drawings will be referred to as the front and rear of the compressor, respectively.

Figure 3:
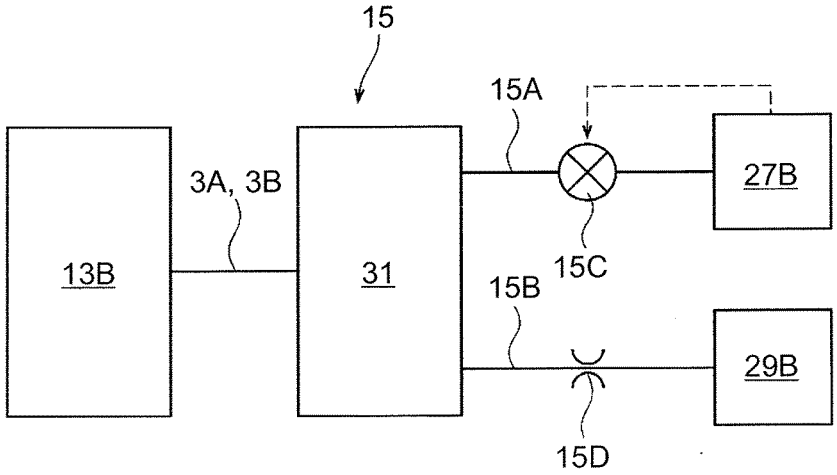
FIG. 3 is a schematic diagram of a control mechanism of the compressor of FIG. 1.

The compressor includes a housing 1, a drive shaft 3 having an axis of rotation O1 extending in the longitudinal direction of the compressor, a swash plate 5, a link mechanism 7, a plurality of pistons 9, and an actuator 13. As shown in FIG. 3 the compressor further includes a control mechanism 15.

Referring to FIGS. 1 and 2, the housing 1 includes a first housing member 17, a second housing member 19, a first cylinder block 21, a second cylinder block 23, a first valve-forming plate 39, and a second valve-forming plate 41.

The first housing member 17 is formed with a boss 17A projecting frontward and having therein a shaft seal device 25. The first housing member 17 has therein an annular first suction chamber 27A and an annular first discharge chamber 29A. The first suction chamber 27A is located radially inward of the first housing member 17, and the first discharge chamber 29A is located radially outward of the first suction chamber 27A in the first housing member 17.

The first housing member 17 further has therein a first front passage 18A. The first front passage 18A is in communication at the front end thereof with the first discharge chamber 29A and is opened at the rear end thereof to the rear end of the first housing member 17.

A part of the aforementioned control mechanism 15 is formed in the second housing member 19. The second housing member 19 has therein an annular second suction chamber 27B, an annular second discharge chamber 29B, and a pressure control chamber 31. The pressure control chamber 31 is located in the center of the second housing member 19. The second suction chamber 27B is located radially outward of the pressure control chamber 31 in the second housing member 19. The second discharge chamber 29B is located radially outward of the second suction chamber 27B in the second housing member 19.

The second housing member 19 further has therein a first rear passage 20A. The first rear passage 20A is in communication at the rear end thereof with the second discharge chamber 29B and connected at the front end thereof to the front end of the second housing member 19.

The first cylinder block 21 is disposed on the front side of the compressor between the first housing member 17 and the second cylinder block 23. The first cylinder block 21 has therein a plurality of first cylinder bores 21A that extends along the axis of rotation O1 of the drive shaft 3. The first cylinder bores 21A are spaced angularly at a regular interval around the drive shaft 3. A first shaft hole 21B is formed through the first cylinder block 21, and the drive shaft 3 is inserted through the first shaft hole 21B. A first slide bearing 22A is provided in the first shaft hole 21B.

The first cylinder block 21 further has at the center thereof a first recess 21C that is formed coaxially with the first shaft hole 21B and communicates with the first shaft hole 21B. The first recess 21C has an inner diameter that is larger than that of the first shaft hole 21B. A first thrust bearing 35A is provided in the first recess 21C.

The first cylinder block 21 has therein a first connecting passage 37A and a second front passage 18B. The front ends of the first connecting passage 37A and the second front passage 18B are opened to the front end of the first cylinder block 21 and the rear ends of the first connecting passage 37A and the second front passage 18B are opened to the rear end of the first cylinder block 21.

The second cylinder block 23 is disposed between the first cylinder block 21 and the second housing member 19 in the rear part of the compressor. The second cylinder block 23 and the first cylinder block 21 are connected together thereby to form a swash plate chamber 33 therebetween. The swash plate chamber 33 is in communication with the first recess 21C. Thus, the first recess 21C forms a part of the swash plate chamber 33.

The second cylinder block 23 has therein a plurality of second cylinder bores 23A that extends along the axis of rotation O1 of the drive shaft 3 and has the same diameter as the first cylinder bores 21A formed in the first cylinder block 21. As with case of the first cylinder bores 21A, the second cylinder bores 23A are spaced angularly at a regular interval around the drive shaft 3 in the second cylinder block 23. Each second cylinder bore 23A is paired with its corresponding first cylinder bore 21A. Any number of the first and second cylinder bores 21A, 23A may be formed in the housing as long as the first and the second cylinder bores 21A, 23A are provided in pairs.

The second cylinder block 23 has therein a second shaft hole 23B through which the drive shaft 3 is inserted. A second slide bearing 22B is provided in the second shaft hole 23B. It is to be noted that the first and second slide bearings 22A, 22B may be replaced with rolling bearings.

In addition, the second cylinder block 23 has at the center thereof a second recess 23C that is formed coaxially with the second shaft hole 23B and communicates with the second shaft hole 23B. The second recess 23C has an inner diameter that is larger than that of the second shaft hole 23B. A second thrust bearing 35B is provided in the second recess 23C.

The second cylinder block 23 has a discharge port 23D, a junction 23J, a suction port 23S, a third front passage 18C, a second rear passage 20B, and a second connecting passage 37B. The discharge port 23D and the junction 23J communicate with each other. The junction 23J is connected through the discharge port 23D to a condenser (not shown) that forms the refrigeration circuit of the vehicle air conditioner. The suction port 23S and the swash plate chamber 33 are in communication with each other. The swash plate chamber 33 is connected to an evaporator (not shown) that forms the refrigeration circuit of the vehicle air conditioner through the suction port 23S.

The third front passage 18C is in communication at the rear end thereof with the junction 23J and is opened at the front end thereof to the front end of the second cylinder block 23 to be in communication with the second front passage 18B. The second rear passage 20B is in communication at the front end thereof with the junction 23J and is opened at the rear end thereof to the rear end of the second cylinder block 23. The second connecting passage 37B is opened at the front end thereof to the swash plate chamber 33 and at the rear end thereof to the rear end of the second cylinder block 23.

The first housing member 17 and the first cylinder block 21 are joined together with the first valve-forming plate 39 interposed therebetween. The second housing member 19 and the second cylinder block 23 are joined together with the second valve-forming plate 41 interposed therebetween.

The first valve-forming plate 39 includes a first valve plate 390, a first suction valve plate 391, a first discharge valve plate 392, and a first retainer plate 393. The first valve plate 390 and the first suction valve plate 391 extend radially to the outer peripheries of the first housing member 17 and the first cylinder block 21. The first valve plate 390, the first discharge valve plate 392, and the first retainer plate 393 have therethrough a first suction hole 390A for each of the first cylinder bores 21A. The first valve plate 390 and the first suction valve plate 391 have therethrough a first discharge hole 390B for each of the first cylinder bores 21A. In addition, the first valve plate 390, the first suction valve plate 391, the first discharge valve plate 392, and the first retainer plate 393 have therethrough a first suction communication hole 390C. The first valve plate 390 and the first suction valve plate 391 have therethrough a first discharge communication hole 390D.

Each first cylinder bore 21A is communicable with the first suction chamber 27A through the first suction hole 390A and is communicable also with the first discharge chamber 29A through the first discharge hole 390B. The first suction chamber 27A and the first connecting passage 37A are in communication with each other through the first suction communication hole 390C. The first front passage 18A and the second front passage 18B are in communication with each other through the first discharge communication hole 390D.

The first suction valve plate 391 is provided on the rear surface of the first valve plate 390. The first suction valve plate 391 has a first suction reed valve 391A for each of the first suction holes 390A to open and close its corresponding first suction hole 390A by elastic deformation. The first discharge valve plate 392 is provided on the front surface of the first valve plate 390. The first discharge valve plate 392 has a first discharge reed valve 392A for each of the first discharge holes 390B to open and close its corresponding first discharge hole 390B by elastic deformation. The first retainer plate 393 is provided on the front surface of the first discharge valve plate 392 and restricts the opening of the first discharge reed valve 392A.

The second valve-forming plate 41 includes a second valve plate 410, a second suction valve plate 411, a second discharge valve plate 412, and a second retainer plate 413. The second valve plate 410 and the second suction valve plate 411 extend radially to the outer peripheries of the second housing member 19 and the second cylinder block 23. The second valve plate 410, the second discharge valve plate 412, and the second retainer plate 413 have therethrough a second suction hole 410A for each of the second cylinder bores 23A. The second valve plate 410 and the second suction valve plate 411 have therethrough a second discharge hole 410B for each of the second cylinder bores 23A. In addition, the second valve plate 410, the second suction valve plate 411, the second discharge valve plate 412, and the second retainer plate 413 have therethrough a second suction communication hole 4100. The second valve plate 410 and the second suction valve plate 411 have therethrough a second discharge communication hole 410D.

Each second cylinder bore 23A is communicable with the second suction chamber 27B through the second suction hole 410A and is communicable also with the second discharge chamber 29B through the second discharge hole 410B. The second suction chamber 27B and the second connecting passage 37B are in communication with each other through the second suction communication hole 410C. The first rear passage 20A and the second rear passage 20B are in communication with each other through the second discharge communication hole 410D.

The second suction valve plate 411 is provided on the front surface of the second valve plate 410. The second suction valve plate 411 has a second suction reed valve 411A for each of the second suction holes 410A to open and close its corresponding second suction hole 410A by elastic deformation. The second discharge valve plate 412 is provided on the rear surface of the second valve plate 410. The second discharge valve plate 412 has a second discharge reed valve 412A for each of the second discharge holes 410B to open and close its corresponding second discharge hole 410B by elastic deformation. The second retainer plate 413 is provided on the rear surface of the second discharge valve plate 412 and restricts the opening of the second discharge reed valve 412A.

In the compressor, the first front passage 18A, the first discharge communication hole 390D, the second front passage 18B, and the third front passage 18C cooperate to form a first discharge passage 18. The first rear passage 20A, the second discharge communication hole 410D and the second rear passage 20B cooperate to form a second discharge passage 20.

The first suction chamber 27A is in communication with the swash plate chamber 33 through the first connecting passage 37A and the first suction communication hole 390C, and the second suction chamber 27B is in communication with the swash plate chamber 33 through the second connecting passage 37B and the second suction communication hole 410C, so that the pressures in the first and second suction chambers 27A, 27B are substantially the same as those in the swash plate chamber 33.

The drive shaft 3 includes a drive shaft body 30, a first support member 43A and a second support member 43B.

The drive shaft body 30 extends along the axis of rotation O1 in the housing 1. The drive shaft body 30 has at the front end thereof a first small diameter portion 30A and at the rear end thereof a second small diameter portion 30B.

The drive shaft body 30 is inserted through the shaft seal device 25, the first and second slide bearings 22A, 22B in the housing 1, so that the drive shaft body 30 and hence the drive shaft 3 is supported rotatably about the axis of rotation O1 in the housing 1. The front end of the drive shaft body 30 of the drive shaft 3 is inserted through the shaft seal device 25 in the boss 17A and the rear end of the drive shaft body 30 of the drive shaft 3 extends into the pressure control chamber 31.

The drive shaft body 30 has mounted thereon the swash plate 5, the link mechanism 7, and the actuator 13 that are disposed in the swash plate chamber 33.

The drive shaft body 30 has at the front end thereof a threaded portion 3E. The drive shaft 3 is connected to a pulley or an electromagnetic clutch (neither shown) through the threaded portion 3E.

The first support member 43A has a substantially cylindrical shape extending along the axis of rotation O1. The first support member 43A is press-fitted on the first small diameter portion 30A of the drive shaft body 30 to be integrated therewith. The first support member 43A is supported by the first slide bearing 22A in the first shaft hole 21B. The first support member 43A has at the rear end thereof a first flange 43F and a mount portion 43D through which a second pin 47B, which will be described later, is inserted.

The first thrust bearing 35A is held between the first flange 43F and the bottom surface of the first recess 21C in the axial direction of the drive shaft 3, with a predetermined preload applied to the first thrust bearing 35A. With this arrangement, a thrust force acting on the drive shaft 3 during the operation of the compressor is supported by the first thrust bearing 35A.

The second support member 43B has a substantially cylindrical shape extending along the axis of rotation O1. The second support member 43B is press-fitted on the second small diameter portion 30B of the drive shaft body 30 to be integrated therewith. The second support member 43B is supported by the second slide bearing 22B in the second shaft hole 23B. The second support member 43B has at the front end thereof a second flange 43G.

The second thrust bearing 35B is held between the second flange 43G and the bottom surface of the second recess 23C in the axial direction of the drive shaft 3 with a predetermined preload applied to the second thrust bearing 35B. With this arrangement, a thrust force acting on the drive shaft body 30 during the operation of the compressor is supported by the second thrust bearing 35B.

As shown in FIGS. 1, 2, 4 through 7A and 7B, the swash plate 5 has a substantially disk shape having a front surface 5A and a rear surface 5B. The swash plate 5 is disposed in the swash plate chamber 33 with the front surface 5A and the rear surfaces 5B thereof facing frontward and rearward of the compressor, respectively. As shown in FIGS. 1 and 2 showing the swash plate 5 in its minimum and maximum positions, respectively, the swash plate 5 is tiltable with respect to a direction perpendicular to the axis of rotation O1 of the drive shaft.

Figure 7B:
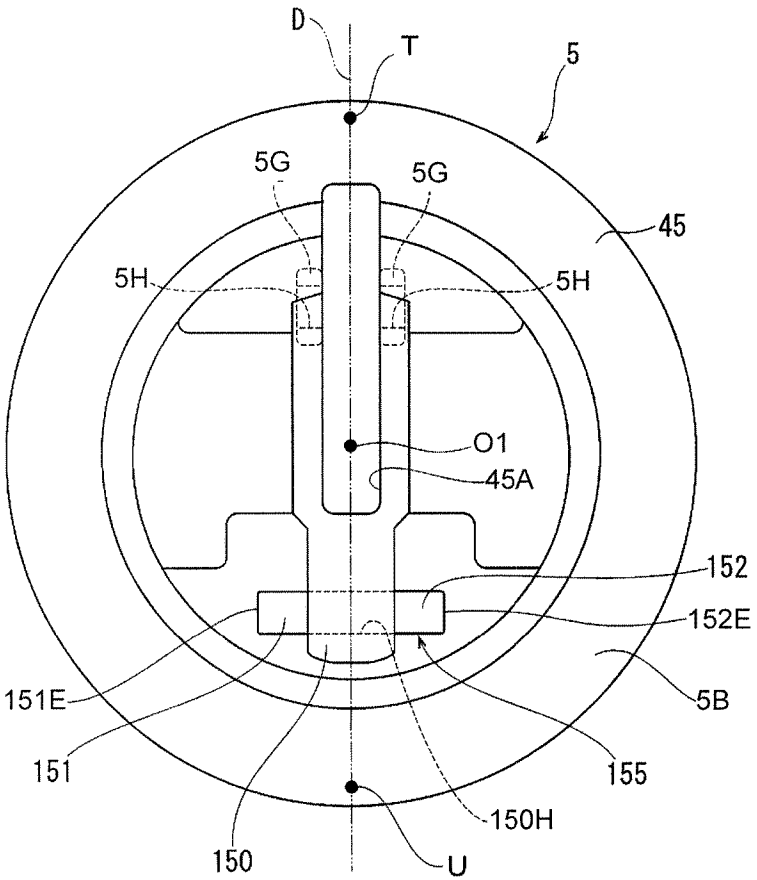
FIG. 7B is a front view of the swash plate as viewed in the direction of arrow Y in FIG. 7A.

Referring to FIG. 7B, symbol T designates a top dead center portion which is a point or portion in the swash plate 5 where the swash plate 5 positions a first head portion 9A of the piston 9 at the top dead center thereof, as shown in FIG. 1, and symbol U designates a bottom dead center portion which is a point or portion of the swash plate 5 where the swash plate 5 positions the first head portion 9A of the piston 9 at the bottom dead center thereof, respectively. Since the compressor of the present embodiment is of a double-headed piston type, the swash plate 5 positions the second head portion 9B of the piston 9 at the bottom dead center thereof when the second head portion 9B is positioned at the top dead center. Symbol D in FIG. 7B designates an imaginary plane that passes through the point T of the swash plate 5 and the axis of rotation O1 of the drive shaft 3.

Figure 6:
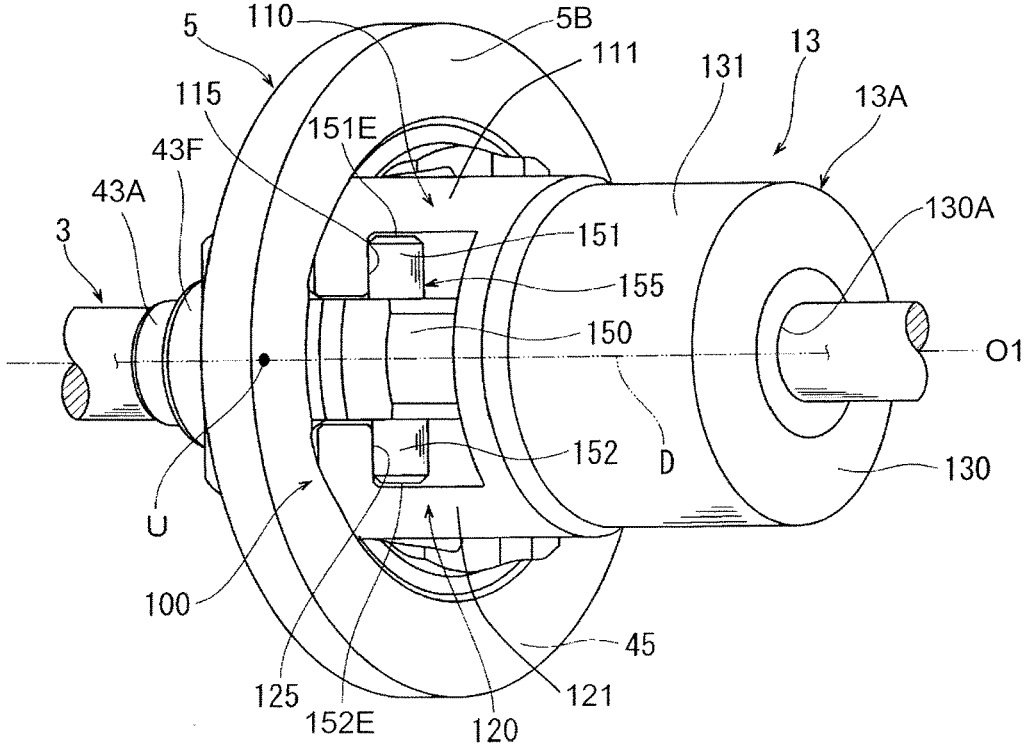
FIG. 6 is a fragmentary perspective view of the compressor as viewed in the direction of arrow Z in FIG. 5.
Figure 7A:
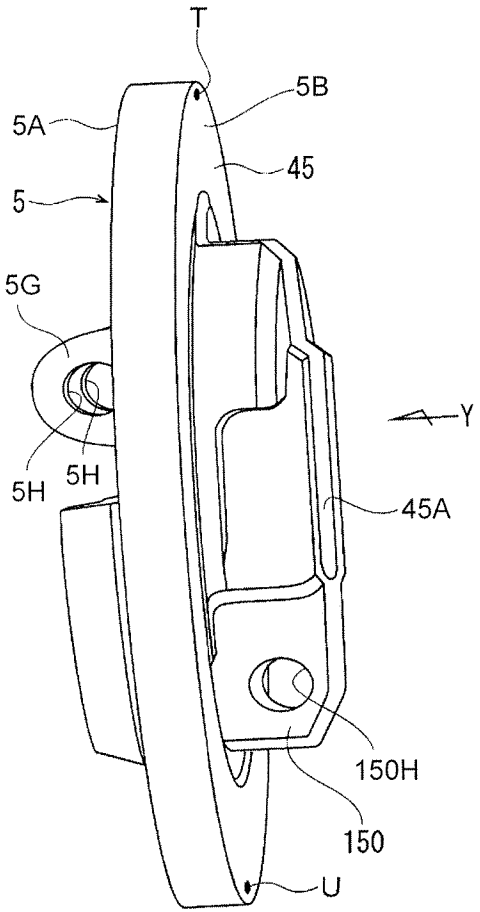
FIG. 7A is a perspective view of a swash plate of the compressor of FIG. 1.

As shown in FIGS. 1, 2, 6, 7A and 7B, the swash plate 5 includes a ring plate 45 having an annular shape. As shown in FIG. 7A, the part of the swash plate 5 that is radially inward of the ring plate 45 is partially projected or recessed in a direction of the axis of rotation O1 so as to adjust the weight balance of the swash plate 5 and to avoid the interference with a first arm 110 and a second arm 120, which will be described later.

As shown in FIGS. 7A and 7B, an insertion hole 45A is formed through the swash plate 5 in the axial direction of the axis of rotation O1. The insertion hole 45A has a substantially rectangular shape formed so as to have therein the axis of rotation O1 and extending toward the top dead center portion T. As shown in FIGS. 1 and 2, the swash plate 5 is mounted on the drive shaft 3 in the swash plate chamber 33 with the drive shaft body 30 inserted through the insertion hole 45A of the ring plate 45 of the swash plate 5.

As shown in FIGS. 1, 2 and 4 to 7A and 7B, the swash plate 5 includes a traction portion 150 and a link pin 155 that connects the swash plate 5 to a movable body 13A, which will be described later. The traction portion 150 and the link pin 155 form a connecting mechanism 100. As shown in FIGS. 7A and 7B, the traction portion 150 is formed at a position in the swash plate 5 radially inward of the ring plate 45 and is closer to the bottom dead center portion U than the insertion hole 45A is, and projects rearward from the rear surface 5B of the swash plate 5. A pin hole 150H is formed through the traction portion 150 in a direction perpendicular to the imaginary plane D.

As shown in FIGS. 6 and 7B, the link pin 155 is a metal member having a substantially cylindrical shape and held by the traction portion 150. The link pin 155 is fixed in the pin hole 150H such that the opposite ends of the link pin 155 extend out from the pin hole 15H. The link pin 155 has at one end thereof a first shaft portion 151 and at the other end thereof a second shaft portion 152.

As shown in FIGS. 4, 5, 7A and 7B, the swash plate 5 has a pair of connecting portions 5G that connect the swash plate 5 and a lug arm 49, which will be described later. As shown in FIGS. 7A and 7B, the connecting portions 5G are formed at positions in the swash plate 5 that are radially outward of the insertion hole 45A of the ring plate 45 of the swash plate 5 and adjacent to the top dead center portion T. The connecting portions 5G project frontward from the front surface 5A of the swash plate 5 and are disposed on opposite sides of the insertion hole 45A across the imaginary plane D, projecting frontward from the front surface 5A of the swash plate 5. Each connecting portion 5G has therethrough a first pin hole 5H extending perpendicularly to the imaginary plane D.

Referring to FIGS. 1 and 2, a return spring (not shown) is provided between the first flange 43F and the ring plate 45. Specifically, the return spring is mounted with the front end thereof set in contact with the first flange 43F and at the rear end thereof set in contact with the ring plate 45. The return spring urges the first flange 43F and the ring plate 45 away from each other.

As shown in FIGS. 1, 2, 4 and 5, the link mechanism 7 includes the aforementioned lug arm 49, a first pin 47A, and the aforementioned second pin 47B.

Referring to FIGS. 1 and 2, the lug arm 49 is disposed frontward of the swash plate 5 in the swash plate chamber 33 and positioned between the swash plate 5 and the first support member 43A. The lug arm 49 has a substantially L-shape and has at the rear end thereof a weight 49A.

The first pin 47A is inserted through the rear end of the lug arm 49 with the opposite ends of the first pin 47A fixedly fitted in the first pin holes 5H in the respective connecting portions 5G, thus connecting the rear end of the lug arm 49 and the swash plate 5. The lug arm 49 is supported swingably about a first axis M1 that extends perpendicularly to the imaginary plane D and corresponds to the axis of the first pin 47A.

The front end of the lug arm 49 is connected to the first support member 43A by the second pin 47B. Thus, the lug arm 49 is supported swingably about a second axis M2 that extends parallel to the first axis M1 and corresponds to the axis of the second pin 47B and relative to the first support member 43A or the drive shaft 3.

The weight 49A is provided forming a rear part of the lug arm 49. Specifically, the weight 49A is located on the side of the first axis M1 that is opposite from the second axis M2. With the lug arm 49 connected to the swash plate 5 by the first pin 47A, the weight 49A is positioned in the insertion hole 45A of the swash plate 5. The centrifugal force caused by the rotation of the swash plate 5 about the axis of rotation O1 acts on the weight 49A.

In the compressor of the present embodiment, the swash plate 5 is connected to the drive shaft 3 through the link mechanism 7, so that the swash plate 5 is rotatable with the drive shaft 3. In other words, the swash plate 5 is mounted on the drive shaft 3 for rotation therewith in the swash plate chamber 33. With the swinging movement of the opposite ends of the lug arm 49 about the first axis M1 and the second axis M2, respectively, the inclination angle of the swash plate 5 with respect to an imaginary plane extending perpendicularly to the axis O1 is variable between the maximum inclination angle shown in FIGS. 1 and 4 and the minimum inclination angle shown in FIGS. 2, 5 and 6.

As shown in FIGS. 1 and 2, the pistons 9 are double-headed pistons each having at the front end thereof the first head portion 9A and at the rear end thereof the second head portion 9B. Each first head portion 9A is reciprocally movably received in the corresponding first cylinder bore 21A and a first compression chamber 53A is defined by the first head portion 9A and the first valve-forming plate 39 in each first cylinder bore 21A. In other words, the first head portions 9A of the pistons 9 are received in the respective first cylinder bores 21A so as to form the first compression chambers 53A. Each second head portion 9B is reciprocally movably received in the corresponding second cylinder bore 23A and a second compression chamber 53B is defined by the second head portion 9B and the second valve-forming plate 41 in each second cylinder bore 23A. In other words, the second head portions 9B of the pistons 9 are received in the respective second cylinder bores 23A.

Each piston 9 has at the center thereof an engaging portion 9C to receive therein a pair of hemispherical shoes 11A, 11B. The shoe 11A and the shoe 11B slide on the front surface 5A and the rear surface 5B of the swash plate 5, respectively. The rotation of the swash plate 5 is converted into the reciprocal motion of the piston 9 by way of the shoes 11A, 11B. Thus, the first head portion 9A and the second head portion 9B of the piston 9 are reciprocally movable by the rotation of the swash plate 5 in their corresponding first cylinder bore 21A and the second cylinder bore 23A, respectively, for a stroke length that is determined by the inclination angle of the swash plate 5.

In this compressor, the positions of the top dead center of the first head portion 9A and the second head portion 9B are variable with the change of the stroke length that is caused by the change of the inclination angle of the swash plate 5. Specifically, the top dead center of the second head portion 9B moves a longer distance than the first head portion 9A does as the inclination angle of the swash plate 5 is reduced.

The actuator 13 is disposed rearward of the swash plate 5 in the swash plate chamber 33 and movable into and out of the second recess 23C. The actuator 13 includes a partitioning body 13C and the aforementioned movable body 13A and a control chamber 13B that is formed between the partitioning body 13C and the movable body 13A. In the present embodiment, the partitioning body 13C and the movable body 13A are made of a metal such as a steel and an aluminum alloy. It is to be noted that the partitioning body 13C and the movable body 13A need not be made of a metal, but any suitable material may be used for the partitioning body 13C and the movable body 13A.

The partitioning body 13C has a substantially annular disk shape extending radially outwardly from the axis of rotation O1 and has at the center thereof an insertion hole 133. An O-ring 139B is provided in the outer periphery of the partitioning body 13C. The drive shaft body 30 is press-fitted into the insertion hole 133 of the partitioning body 13C, so that the drive shaft body 30 is rotatable with the partitioning body 13C facing the swash plate 5 from behind thereof. It is to be noted that the partitioning body 13C may be mounted on the drive shaft body 30 so as to be movable along the axis of rotation O1.

A spring (not shown) is provided between the partitioning body 13C and the ring plate 45, acting so as to reduce the inclination angle of the swash plate 5. Specifically, the spring is mounted with the rear end thereof set in contact with the partitioning body 13C and the front end thereof set in contact with the ring plate 45. The spring urges the partitioning body 13C and the ring plate 45 away from each other.

As shown in FIGS. 1, 2, 4 to 6, and 8 through 10, the movable body 13A includes a bottom wall 130, a peripheral wall 131, the first arm 110, and the second arm 120. Although the first arm 110 is not shown in FIGS. 1, 2, and 10B, the first arm 110 is disposed on the side of the imaginary plane D that is opposite to the second arm 120.

As shown in FIGS. 1, 2, 6 and 9, the bottom wall 130 forms the rear part of the movable body 13A and has a substantially disk shape extending radially outwardly. The bottom wall 130 has an insertion hole 130A through which the second small diameter portion 30B of the drive shaft body 30 is inserted. As shown in FIGS. 1 and 2, an O-ring 139A is provided in the inner periphery of the bottom wall 130.

As shown in FIGS. 1, 2, 8 and 9, the peripheral wall 131 of the movable body 13A has a cylindrical shape extending frontward from the outer periphery of the bottom wall 130. The inner diameter of the peripheral wall 131 is formed slightly larger than the outer diameter of the partitioning body 13C.

As shown in FIGS. 1, 2 and 6, the drive shaft body 30 is inserted through the insertion hole 130A of the movable body 13A. Thus, the movable body 13A is mounted on the drive shaft body 30 for rotation therewith and movable relative to the partitioning body 13C along the axis of rotation O1.

As shown in FIGS. 1 and 2, the partitioning body 13C is disposed in the movable body 13A in such a manner that the movable body 13A is circumferentially surrounded by the peripheral wall 131 of the movable body 13A. The O-ring 139B is provided in the outer periphery of the partitioning body 13C to seal between the partitioning body 13C and the movable body 13A. As the movable body 13A moves along the axis of rotation O1, the inner peripheral surface of the peripheral wall 131 of the movable body 13A slides on the outer peripheral surface of the partitioning body 13C.

As shown in FIGS. 1, 2, 4 to 6, and 8 through 10, the first arm 110, the second arm 120, the traction portion 150 and the link pin 155 cooperate to form the connecting mechanism 100 that connects the swash plate 5 and the movable body 13A.

Figure 9:
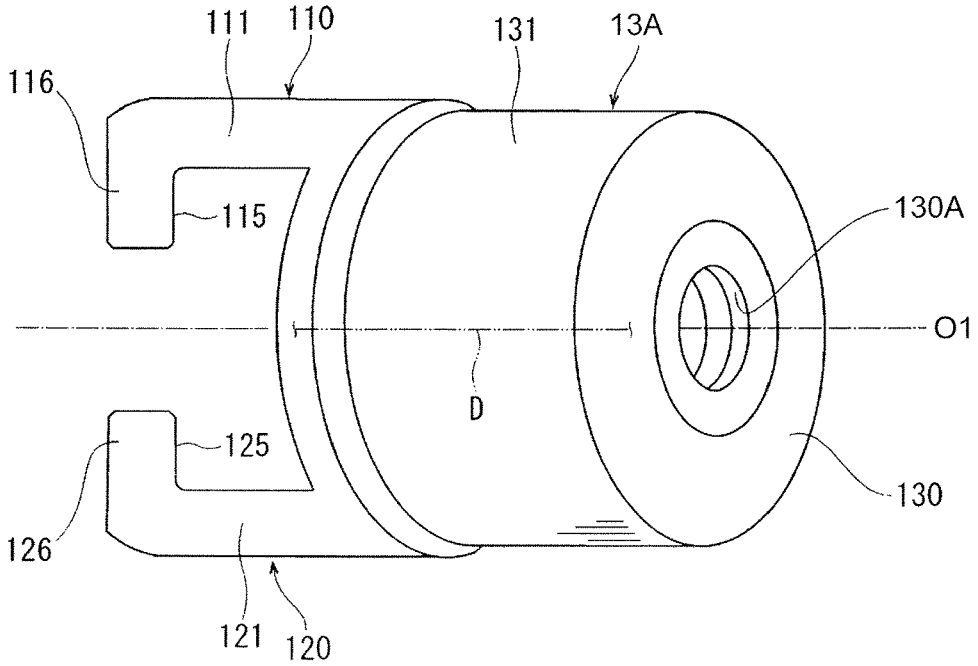
FIG. 9 is a perspective view of the movable body as viewed in the direction of arrow Z in FIG. 5.

The first and second arms 110, 120 extend frontward from the movable body 13A toward the swash plate 5. As shown in FIGS. 9 and 10A, the first arm 110 is disposed on one side of the imaginary plane D that is adjacent to the first shaft portion 151 of the link pin 155, and the second arm 120 is disposed on the other side of the imaginary plane D that is adjacent to the second shaft portion 152 of the link pin 155. As shown in FIG. 6, the traction portion 150 extends rearward from the swash plate 5 toward the movable body 13A and is disposed between the first arm 110 and the second arm 120.

Figure 8:
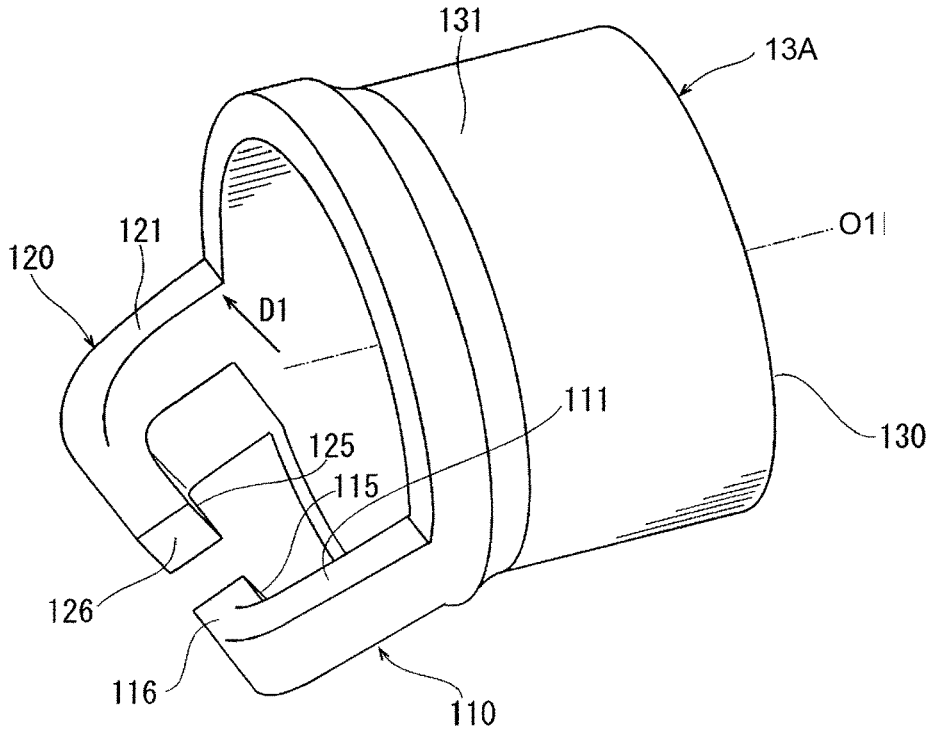
FIG. 8 is a perspective view of a movable body of the compressor of FIG. 1.

As shown in FIGS. 8 through 10, the first arm 110 includes a first facing portion 111 and a first engaging portion 116. Similarly, the second arm 120 includes a second facing portion 121 and a second engaging portion 126.

The rear ends of the first and second facing portions 111, 121 are connected to the front end of the movable body 13A at positions that are closer to the bottom dead center portion U than to the axis of rotation O1. The distances from the front end of the first and second facing portions 111, 121 to the axis of rotation O1 is greater than those from the rear ends of the first and second facing portions 111, 121.

As shown in FIGS. 8 through 10, the front ends of the first and second arms 110, 120 are bent thereby to form the first and second engaging portions 116, 126 extending toward the imaginary plane D, respectively. Specifically, the first engaging portion 116 is formed extending from the front end of the first facing portion 111 and the second engaging portion 126 extending from the front end of the second facing portion 121 toward the imaginary plane D. As shown in FIG. 9, the first engaging portion 116 and the second engaging portion 126 are disposed in facing relation to each other across the imaginary plane D.

As shown in FIGS. 8 through 10, the first engaging portion 116 of the first arm 110 has a flat first guide surface 115 facing away from the swash plate 5. The second engaging portion 126 of the second arm 120 has a flat second guide surface 125 facing away from the swash plate 5. The first and second guide surfaces 115, 125 are tilted so that distances from the first and second guide surfaces 115, 125 to the axis of rotation O1 increase toward the rear of the compressor.

As shown in FIGS. 1, 2, and 4 through 6, the first guide surface 115 of the first arm 110 is in contact with the first shaft portion 151 of the link pin 155, and the second guide surface 125 of the second arm 120 is in contact with the second shaft portion 152 of the link pin 155, respectively.

Figure 5:
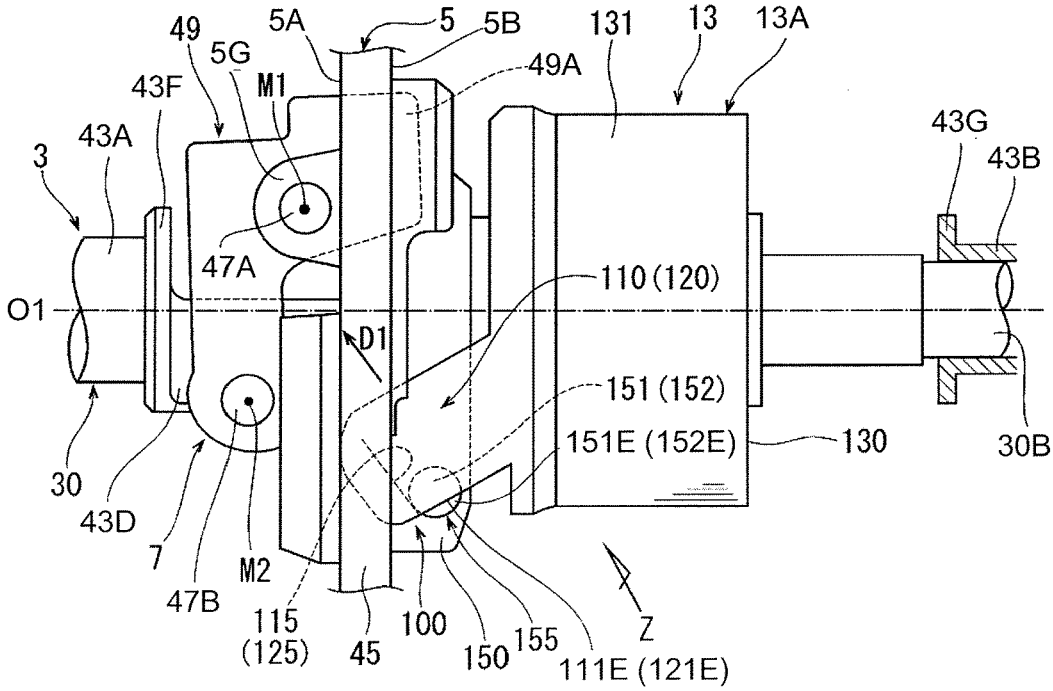
FIG. 5 is a fragmentary schematic side view of the compressor of FIG. 1 at its minimum displacement.

As shown, for example, in FIGS. 5 and 6, the first facing portion 111 of the first arm 110 faces an end surface 151E of the first shaft portion 151 of the link pin 155 on one side of the imaginary plane D, and the second facing portion 121 of the second arm 120 faces an end surface 152E of the second shaft portion 152 of the link pin 155 on the other side of the imaginary plane D, respectively. The end surfaces 151E, 152E correspond to the first end and the second end of the present invention.

Figure 11:
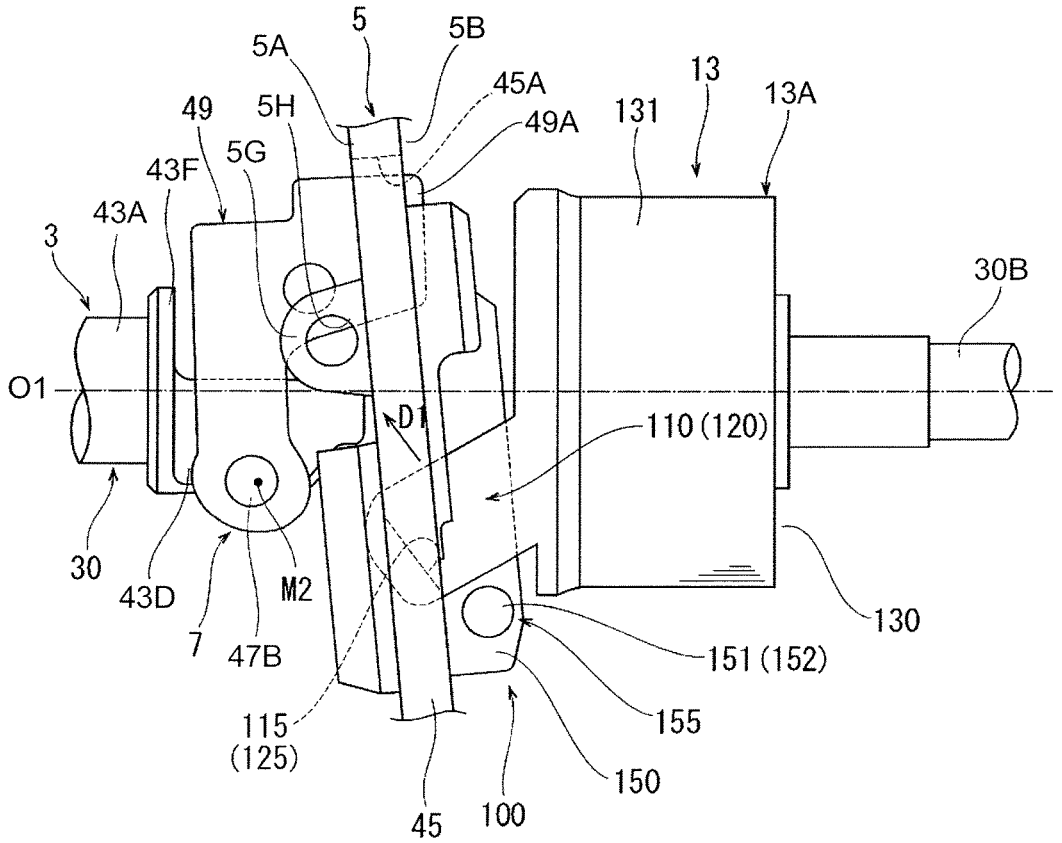
FIG. 11 is a fragmentary side view of the compressor according to the embodiment of the present invention, illustrating a procedure for assembling a link mechanism, the swash plate, and the movable body.

With a change in the inclination angle of the swash plate 5, the first and second shaft portions 151, 152 of the link pin 155 are movable in a reciprocating manner along the first guide surface 115 of the first arm 110 and the second guide surface 125 of the second arm 120, respectively. Referring to FIG. 11, for example, D1 designates a direction in which the link pin 155 moves on the first and second guide surfaces 115, 125 with an increase of the inclination angle of the swash plate 5. The moving direction D1 is directed frontward and inclined toward the axis of rotation O1.

As shown in FIGS. 6, 8 through 10, each of the first and second arms 110, 120 has an opening that is open in the direction opposite to the moving direction D1 of the link pin 155 so that the first and second shaft portions 151, 152 of the link pin 155 are allowed to enter thereinto. Specifically, each of the first and second arms 110, 120 has an opening on the side thereof that corresponds to the upstream side of the moving direction D1 of the link pin 155 so that the first and second shaft portions 151, 152 of the link pin 155 are allowed to enter thereinto. It is to be noted that the opening of the first arm 110 and the opening of the second arm 120 that are open in the direction opposite to the moving direction D1 of the link pin 155 correspond to the first opening and the second opening, respectively, of the present invention.

As shown in FIGS. 8 through 10, each of the first and second arms 110, 120 has an opening that is open in the moving direction D1 of the link pin 155 so that the first and second shaft portions 151, 152 of the link pin 155 are allowed to enter thereinto. Specifically, each of the first and second arms 110, 120 has an opening on the other side thereof that corresponds to the downstream side of the moving direction D1 of the link pin 155 so that the first and second shaft portions 151, 152 of the link pin 155 are allowed to enter thereinto. It is to be noted that the opening of the first arm 110 and the opening of the second arm 120 that are open in the moving direction of the link pin 155 correspond to the third opening and the fourth opening, respectively, of the present invention.

Figure 4:
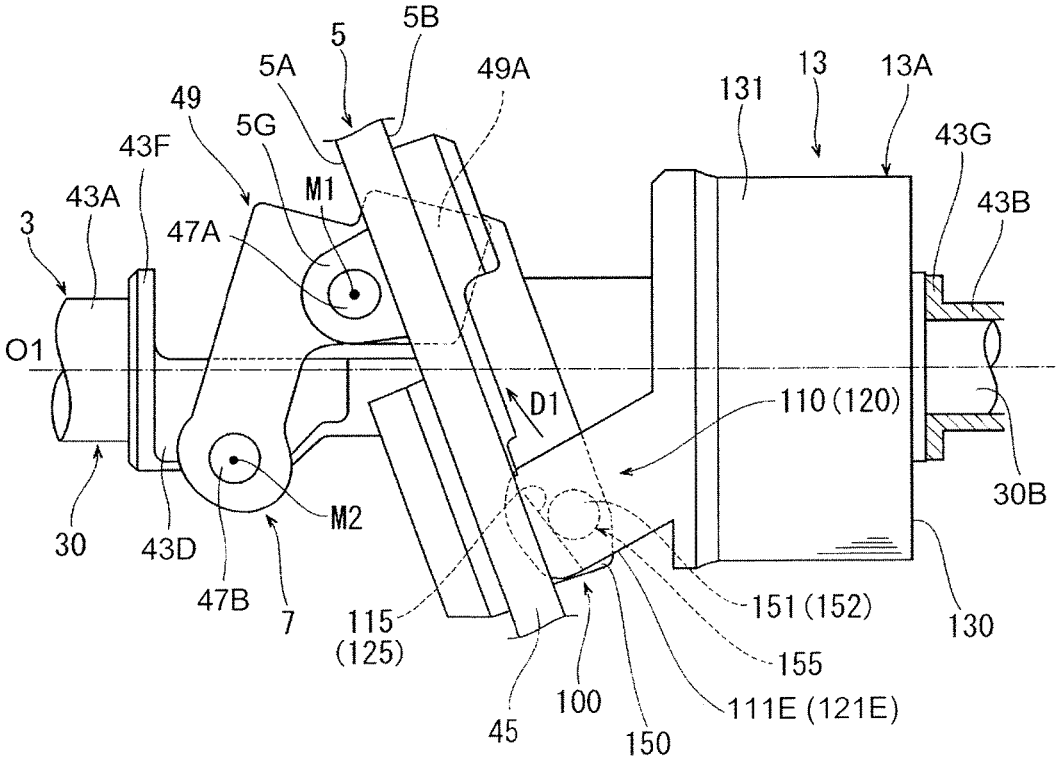
FIG. 4 is a fragmentary schematic side view of the compressor of FIG. 1 at its maximum displacement.
Figure 10B:
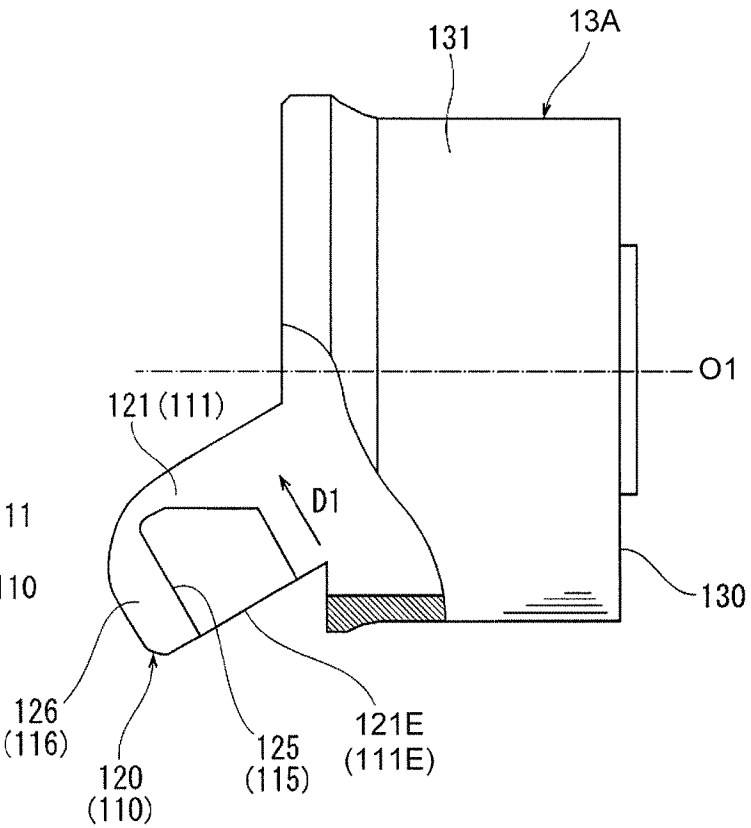
FIG. 10B is a side view of the movable body.
Figure 10A:
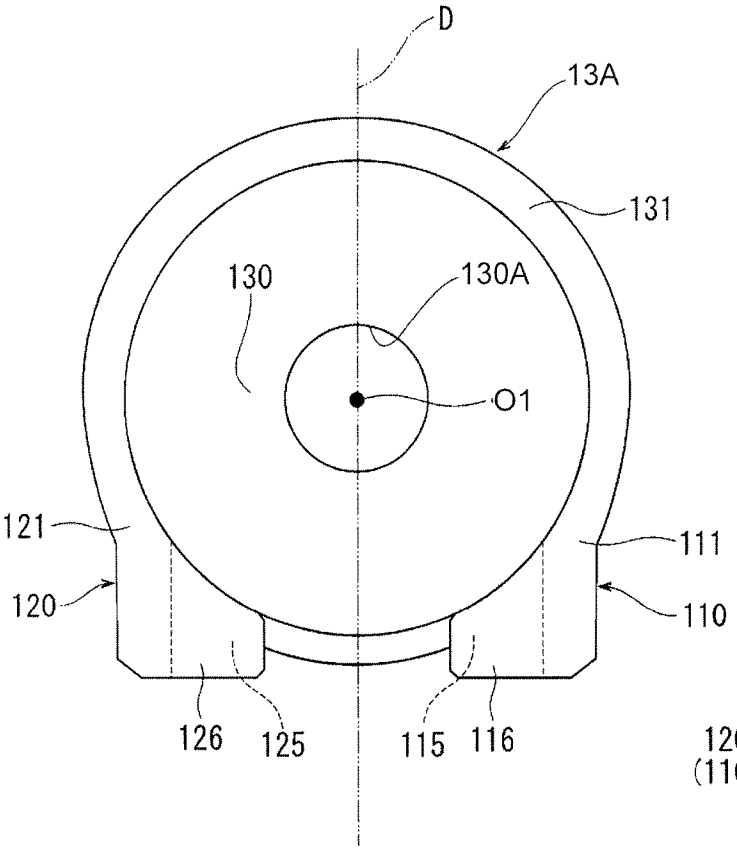
FIG. 10A is a front view of the movable body.

As shown in FIGS. 4, 5, and 10B, the first facing portion 111 has a slanted portion 111E that extends obliquely toward the axis of rotation O1. The second facing portion 121 also has a slanted portion 121E that extends obliquely toward the axis of rotation O1. When the inclination angle of the swash plate 5 is minimum, as shown in FIG. 5, part of the end surface 151E of the first shaft portion 151 is exposed from the slanted portion 111E of the first facing portion 111. Although not shown in the drawing, when the inclination angle of the swash plate 5 is minimum, part of the end surface 152E of the second shaft portion 152 is exposed from the slanted portion 121E of the second facing portion 121.

The following will describe the assembling procedure of the swash plate 5 and the movable body 13A through the connecting mechanism 100. Firstly, the first support member 43A of the drive shaft 3 and the front end of the lug arm 49 are connected together by the second pin 47B, as shown in FIG. 11.

Then, the second small diameter portion 30B of the drive shaft body 30 before being press-fitted into the second support member 43B is inserted through the insertion hole 45A of the swash plate 5. The swash plate 5 thus having the drive shaft 3 inserted through the insertion hole 45A thereof is brought close to the lug arm 49 and the weight 49A of the lug arm 49 is inserted through the insertion hole 45A of the swash plate 5. At this time, the traction portion 150 of the swash plate 5 is located radially outward of and eccentric to the axis of rotation O1 of the drive shaft 3.

Subsequently, the partitioning body 13C and the movable body 13A of the actuator 13 are assembled on the drive shaft body 30 from the second small diameter portion 30B side, and the movable body 13A is moved frontward toward the swash plate 5. Then the position of the swash plate 5 is adjusted so that the first and second shaft portions 151, 152 of the link pin 155 are located radially outward of the first and second guide surfaces 115, 125, respectively.

The swash plate 5 is moved in the moving direction D1 so that the first and second shaft portions 151, 152 of the link pin 155 are placed in contact with the first and second guide surfaces 115, 125 of the first and second arms 110, 120, respectively. After the first pin 47A is inserted through the rear end of the lug arm 49, the opposite ends of the first pin 47A are fixedly fitted to the first holes 5H of the connecting portions 5G, respectively. Accordingly, the swash plate 5 and the movable body 13A are connected together through the connecting mechanism 100.

As shown in FIGS. 1 and 2, the control chamber 13B that is defined by the bottom wall 130 and the peripheral wall 131 of the movable body 13A and the partitioning body 13C is sealingly separated from the swash plate chamber 33.

The second small diameter portion 30B of the drive shaft body 30 has therein an axial passage 3A that extends frontward from the rear end of the drive shaft body 30 along the axis of rotation O and a radial passage 3B that extends radially from the front end of the axial passage 3A and is opened to the outer peripheral surface of the drive shaft body 30. The axial passage 3A is in communication through the rear end thereof with the pressure control chamber 31 and the radial passage 3B is in communication with the control chamber 13B. Thus, the control chamber 13B and the pressure control chamber 31 communicate with each other through the radial passage 3B and the axial passage 3A.

As shown in FIG. 3, the control mechanism 15 includes a low-pressure passage 15A, a high-pressure passage 15B, a control valve 15C, an orifice 15D, the axial passage 3A and the radial passage 3B.

The low-pressure passage 15A is connected to the pressure control chamber 31 and the second suction chamber 27B. The control chamber 13B, the pressure control chamber 31 and the second suction chamber 27B are connected through the low-pressure passage 15A, the axial passage 3A and the radial passage 3B. The high-pressure passage 15B is connected between the pressure control chamber 31 and the second discharge chamber 29B. The control chamber 13B, the pressure control chamber 31 and the second discharge chamber 29B are connected through the high-pressure passage 15B, the axial passage 3A and the radial passage 3B. The high-pressure passage 15B is provided with the orifice 15D.

The control valve 15C is provided in the low-pressure passage 15A. The control valve 15C controls the opening of the low-pressure passage 15A according to the internal pressure of the second suction chamber 27B.

The compressor of the present embodiment is connected with the aforementioned evaporator (not shown) through a pipe (not shown) connected to the suction port 23S. The compressor is also connected to the aforementioned condenser (not shown) by a pipe (not shown) through the discharge port 23D. The condenser is connected to the evaporator through the pipe and an expansion valve (neither shown). The compressor, the evaporator, the expansion valve and the condenser cooperate to form a refrigeration circuit of the vehicle air conditioner. The evaporator, the expansion valve, the condenser and the pipes are omitted from the illustration in the drawings.

In the compressor having the above-described configuration, the rotation of the swash plate 5 driven by the drive shaft 3 causes each piston 9 to reciprocate in the respective first and second cylinder bores 21A, 23A. The refrigerant gas introduced into the first and second suction chambers 27A, 27B is compressed in the first and second compression chambers 53A, 53B, respectively, and the compressed refrigerant gas is discharged to their corresponding first and second discharge chambers 29A, 29B. The displacement of the pistons and hence the delivery of compressed refrigerant gas from the first and second compression chambers 53A, 53B are varied according to the stroke length of the piston 9.

The refrigerant gas discharged into the first discharge chamber 29A is flowed through the first discharge passage 18 to the junction 23J. Similarly, the refrigerant gas discharged into the second discharge chamber 29B is flowed through the second discharge passage 20 to the junction 23J. The refrigerant gas flowed to the junction 23J is discharged through the discharge port 23D to the condenser through the pipe.

The following will describe the operation of the compressor. In the compressor of the present embodiment, the inclination angle of the swash plate 5 relative to the imaginary plane extending perpendicularly to the axis of rotation O1 of the drive shaft 3 is changed by the actuator 13, which increases or decreases the stroke length of the piston 9 and hence changes the displacement of the compressor.

Firstly, the operation of the compressor in increasing the inclination angle of the swash plate 5 to its maximum position shown in FIG. 1 will be described. In the control mechanism 15 shown in FIG. 3, when the opening of the low-pressure passage 15A is reduced by the control valve 15C, the pressure in the pressure control chamber 31 is increased due to the pressure of the refrigerant gas in the second discharge chamber 29B, and the pressure in the control pressure chamber 13B is increased accordingly. As a result, the variable pressure difference between the control pressure chamber 13B and the swash plate chamber 33 is increased. Accordingly, the movable body 13A of the actuator 13 is moved rearward from the position shown in FIG. 2 against the compression reaction force acting on the swash plate 5 through each piston 9 and enters into the second recess 23C, as shown in FIG. 1.

This causes the movable body 13A to pull the swash plate 5 rearward in the swash plate chamber 33 through the first and second guide surfaces 115, 125 of the first and second arms 110, 120, respectively, and the first and second shaft portions 151, 152 of the link pin 155, against the urging force of the spring (not shown) for reducing the inclination angle of the swash plate 5. In this case, the first and second shaft portions 151, 152 slide on the first and second guide surfaces 115, 125, respectively toward the axis of rotation O1. The swash plate 5 swings counterclockwise about the first axis M1 as seen in FIGS. 1 and 2, and the front end of the lug arm 49 swings clockwise about the second axis M2 to move away from the first flange 43F of the first support member 43A. As a result, the inclination angle of the swash plate 5 is increased thereby to increase the stroke length of the piston 9, and the displacement of the compressor per rotation of the drive shaft 3 is increased. When the inclination angle of the swash plate 5 is maximum, as shown in FIG. 1, the stroke of the pistons 9 is maximum and the displacement of the compressor is maximum.

The operation of the compressor in decreasing the inclination angle of the swash plate 5 from the maximum (FIG. 1) to the minimum position (FIG. 2) will be described. In the control mechanism 15 in FIG. 3, when the opening of the low-pressure passage 15A is increased by the control valve 15C, the pressure in the pressure control chamber 31 and hence the pressure in the control chamber 13B becomes substantially the same as the pressure in the second suction chamber 27B, with the result that the pressure difference between the control chamber 13B and the swash plate chamber 33 becomes small.

The compression reaction force acting on the swash plate 5 through each piston 9 urges the swash plate 5 in the direction that reduces the inclination angle of the swash plate 5. Accordingly, the movable body 13A is pulled or moved frontward in the swash plate chamber 33 through the first and second traction surfaces 115, 125 of the first and second arms 110, 120 and the first and second shaft portions 151, 152 of the link pin 155, resisting the urging force of the return spring. During such movement of the movable body 13A, the first and second shaft portions 151, 152 of the link pin 155 move away from the axis of rotation O1 while sliding on the first and second guide surfaces 115, 125 of the first and second arms 110, 120. As a result, the swash plate 5 is swung clockwise about the axis M1. In addition, the lug arm 49 is swung counterclockwise about the second axis M2, thus moving the front end of the lug arm 49 close to the first flange 43F of the first support member 43A, with the result that the inclination angle of the swash plate 5 is reduced. With the reduction of the inclination angle of the swash plate 5, the stroke length of the piston 9 is decreased and the discharge volume per rotation of the drive shaft 3 is decreased accordingly. When the inclination angle of the swash plate 5 is minimum, as shown in FIG. 2, the stroke length of the piston 9 is minimum and the discharge volume per rotation of the drive shaft 3 becomes minimum accordingly.

As shown in FIGS. 6 and 8 through 10, each of the first and second arms 110, 120 is formed to have an opening that is open in the direction opposite to the moving direction D1 so that the first and second shaft portions 151, 152 are allowed to enter the openings. In the compressor with this configuration, the weight of the compressor may be reduced at the portions that are more distant from the axis of rotation O1 than the first and second guide surfaces 115, 125 of the first and second arms 110, 120. As shown in FIG. 6, in the structure of the compressor in which the first arm 110 includes the first facing portion 111 that faces the end surface 151E of the first shaft portion 151 from the one side of the imaginary plane D and the second arm 120 includes the second facing portion 121 that faces the end surface 152E of the second shaft portion 152 from the other side of the imaginary plane D. With this configuration, the loss of the strength of the first and second 110, 120 due to the above-mentioned reduction of the weight may be compensated by the first and second facing portions 111, 121. Consequently, the first and second shaft portions 151, 152 of the link pin 155 may be located at positions distant from the axis of rotation O1, so that the movable body 13A changes the inclination angle of the swash plate 5 with a smaller force. Furthermore, the center of gravity of the movable body 13A may be located close to the axis of rotation O1 so as to reduce the centrifugal force that acts on the movable body 13A.

Comparative Embodiment

The following will describe a variable displacement type swash plate compressor (hereinafter, the compressor) according to a comparative embodiment of the present invention with reference to FIGS. 12A and 12B. The compressor of the comparative embodiment of the present invention is different from the compressor according to the above-described embodiment in the configuration of the first and second arms 210, 220 of the movable body 13A. Other configurations and parts are the same as their counterparts of the embodiment and, therefore, such same configurations and parts are designated with the same reference numerals, and the descriptions thereof will be omitted or simplified.

The first arm 210 of the compressor according to the comparative embodiment has an elongated hole 210H formed through the front end portion thereof extending perpendicularly to the imaginary plane D and the second arm 220 has an elongated hole 220H formed through the front end portion thereof extending perpendicularly to the imaginary plane D. As shown in FIGS. 12A and 12B, the inner peripheral surface of the elongated hole 210H has a first guide surface 215 that is formed flat and faces away from the swash plate 5. The inner peripheral surface of the elongated hole 220H has a second guide surface 225 that is formed flat and faces away from the swash plate 5. As shown in FIG. 12B, the first and second guide surfaces 215, 225 extend in the moving direction D1. Although not shown in the drawing, the first guide surface 215 is in contact with the first shaft portion 151 of the link pin 155 and the second guide surface 225 is in contact with the second shaft portion 152 of the link pin 155.

Figure 12B:
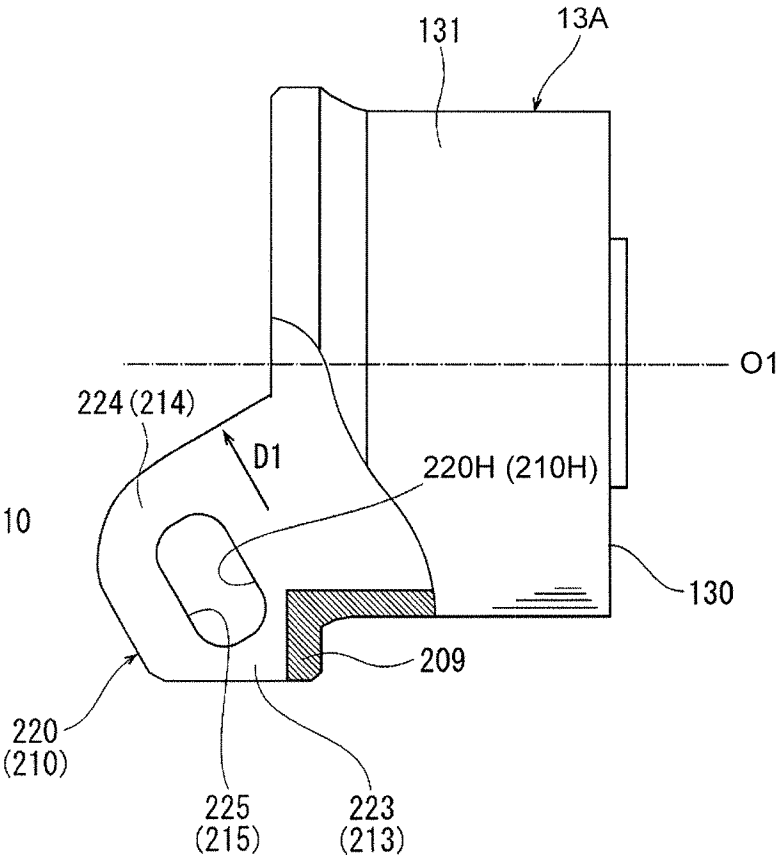
FIG. 12B is a side view of the movable body of FIG. 12A.
Figure 12A:
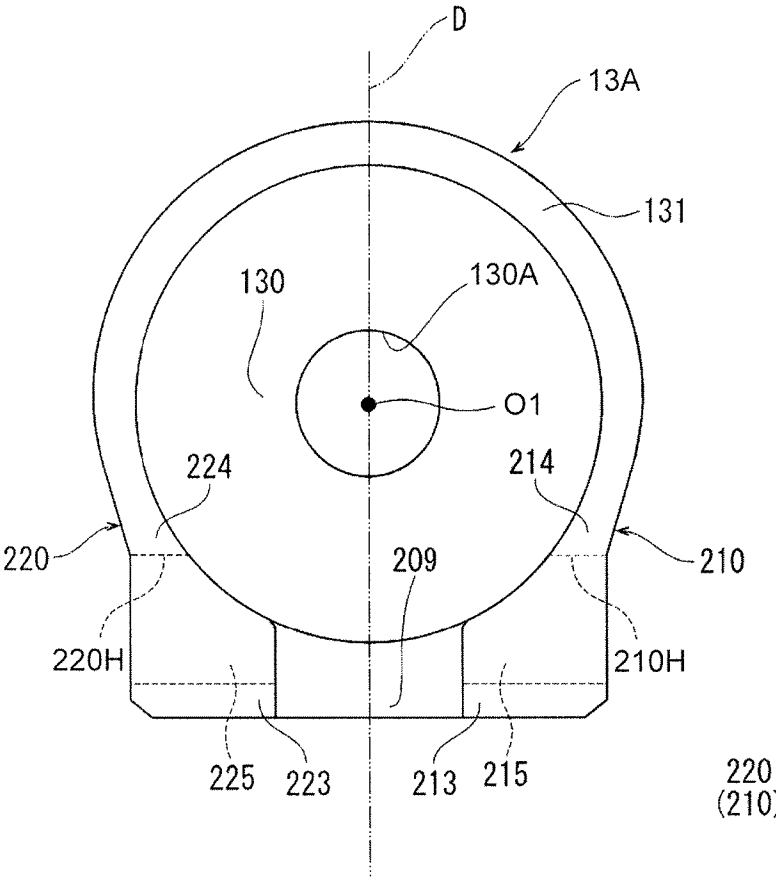
FIG. 12A is a front view of a movable body of a variable displacement type swash plate compressor according to a comparative embodiment of the present invention.

Referring to FIGS. 12A and 12B, in the compressor of the comparative embodiment, the elongated hole 210H of the first arm 210 has peripheral portions 213, 214 that are formed to have a thickness that is large enough to reinforce the strength of the first guide surface 215, and the elongated hole 220H of the second arm 220 also has peripheral portions 223, 224 that are formed to have a thickness that is large enough to reinforce the strength of the second guide surface 225. The peripheral portion 214 of the first arm 210 and the peripheral portion 224 of the second arm 220 are reinforced by being connected to each other through a connecting portion 209.

According to the compressor of the comparative embodiment, the presence of the peripheral portions 213, 214, 223, and 224 and the connecting portion 209 that are spaced distantly away from the axis of rotation O1 increases the weight of the first and second arms 210, 220. As a result, the center of gravity of the movable body 13A is shifted away from the axis of rotation O1 and, therefore, the centrifugal force that acts on the movable body 13A is increased, which causes the movable body 13A to move irregularly, thus hindering the enhancement of smooth operation and the wear resistance of the movable body 13A.

In order to reduce the centrifugal force that acts on the movable body 13A, the movable body 13A may be configured so that its center of gravity is located close to the axis of rotation O1, for example, by locating the elongated holes 210H, 220H close to the axis of rotation O1. In such structure, however, the movable body 13A may not be able to change the inclination angle of the swash plate 5 with a small force and therefore, the pulling force of the movable body 13A may not be efficiently converted into the changing of the inclination angle of the swash plate 5.

As is apparent from comparison with the comparative embodiment, according to the compressor of the embodiment of the present invention, the pulling force of the movable body 13A is converted efficiently into the changing of the inclination angle of the swash plate 5 and the smooth operation and the wear resistance of the movable body 13A that rotates with the drive shaft 3 are enhanced.

Furthermore, as shown in FIG. 6, according to the compressor, the first end surface 151E of the first shaft portion 151 is stopped on the one side of the imaginary plane D by contacting the first facing portion 111 of the first arm 110 and the end surface 152E of the second shaft portion 152 is stopped on the other side of the imaginary plane D by contacting the second facing portion 121 of the second arm 120. This configuration prevents the first and second shaft portions 151, 152 of the link pin 155 from slipping off from the first and second arms 110, 120 in the direction perpendicular to the imaginary plane D.

Furthermore, as shown in FIGS. 6 and 8 through 10, each of the first and second arms 110, 120 has an opening that is open in the moving direction D1 so that the first and second shaft portions 151, 152 are allowed to enter the openings. With this configuration, the weight of the compressor may be reduced at the portions thereof closer to the axis of rotation O1 than to the first and second guide surfaces 115, 125 of the first and second arms 110, 120, respectively, and therefore, the movable body 13A may be configured so that its center of gravity is located adjacent to the axis of rotation O1.

Furthermore, in the compressor in which the first facing portion 111 and the second facing portion 121 of the first and second arms 110, 120 have the slanted portions 111E, 121E, respectively, as shown in FIGS. 4, 5, and 10B, when the inclination angle of the swash plate 5 is minimum, part of the end surface 151E of the first shaft portion 151 and part of the end surface 152E of the second shaft portion 152 are exposed from the slanted portions 111E, 121E, respectively, as shown in FIG. 5. The formation of the slanted portions 111E, 121E helps to further reduce the weight of the first and second arms 110, 120 and, therefore, the movable body 13A may be configured so as to locate its center of gravity further close to the axis of rotation O1. Furthermore, the end surfaces 151E, 152E of the first and second shaft portions 151, 152 are not exposed completely from the slanted portions 111E, 121E. Therefore, the link pin 155 is prevented from slipping off from the first and second arms 110, 120 because the first and second shaft portions 151, 152 of the link pin 155 are contactable with the first and second facing portion 111, 121, respectively.

Modifications

Figure 13A:
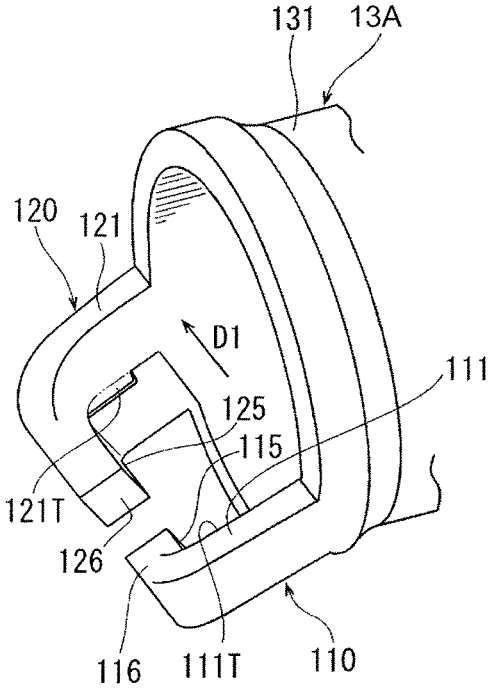
FIG. 13A is a fragmentary perspective view of a movable body of a variable displacement type swash plate compressor according to a modification of the present invention.
Figure 13B:
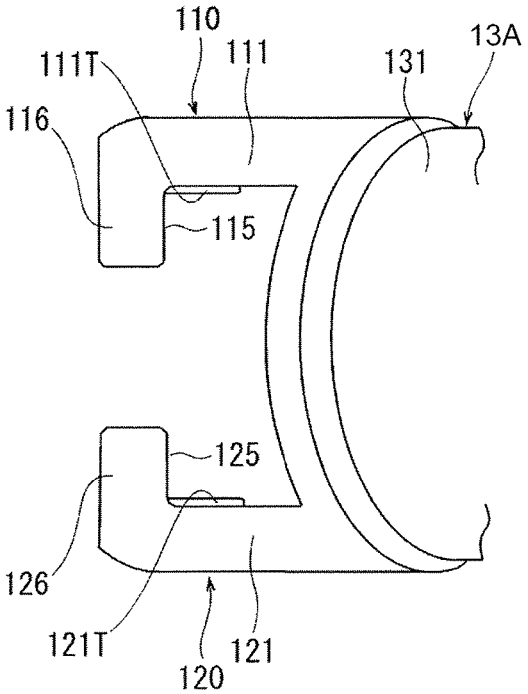
FIG. 13B is another perspective view of the movable body of FIG. 13A as viewed in a direction corresponding to the direction of arrow Z in FIG. 5.

The following will describe one modification of the above-described embodiment of the present invention with reference to FIGS. 13A and 13B.

As shown in FIGS. 13A and 13B, the first arm 110 may have in the first facing portion 111 thereof a projection 111T that covers a part of the first shaft portion 151 of the link pin 155 as viewed in the direction opposite to the moving direction D1. Specifically, the projection 111T may be formed on the first facing portion 111 on the side thereof that corresponds to the upstream side of the moving direction D1.

The second arm 120 may also have in the second facing portion 121 thereof a projection 121T that covers a part of the second shaft portion 152 of the link pin 155 as viewed in the direction opposite to the moving direction D1. Specifically, the projection 121T may be formed on the second facing portion 121 on the side thereof that corresponds to the upstream side of the moving direction D1.

According to the modification, the weight of the first and second arms 110, 120 may be reduced at the portions thereof that are closer to the axis of rotation O1 than to the first and second guide surfaces 115, 125. Furthermore, in assembling the swash plate 5 and the movable body 13A, the projection 111T, 121T may be used to prevent the link pin 155 from slipping off from the first and second arms 110, 120 in the moving direction D1.

Although the present invention has been described in the context of the embodiments, the present invention is not limited to such embodiments and may variously be modified within the scope of the invention.

For example, the link pin may be formed integrally with the traction portion or formed separately from the traction portion. Additionally, the link pin may be formed of a single part or two parts.

The link pin may or may not be held in a rotatable manner by the traction portion.

The actuator 13 may be disposed on the cylinder block 21 side in the swash plate chamber 33 with respect to the swash plate 5.

The present invention is applicable to an air conditioner or the like.

What is claimed is:

1. A variable displacement type swash plate compressor comprising:

a housing having therein a swash plate chamber and a plurality of cylinder bores;

a drive shaft that is rotatably supported in the housing;

a swash plate that is mounted on the drive shaft for rotation therewith in the swash plate chamber;

a link mechanism that connects the drive shaft and the swash plate and permits changing of an inclination angle of the swash plate with respect to a direction perpendicular to an axis of rotation of the drive shaft;

a plurality of pistons that is received in the respective cylinder bores so as to form respective compression chambers and reciprocally movable with the rotation of the swash plate for a length of stroke determined by the inclination angle of the swash plate;

a partitioning body that is mounted on the drive shaft for rotation therewith in the swash plate chamber;

a movable body that is mounted on the drive shaft for rotation therewith and movable relative to the partitioning body along the axis of rotation in the swash plate chamber to thereby change the inclination angle of the swash plate;

a control chamber that is formed between the partitioning body and the movable body and causes the movable body to move with the internal pressure thereof; and a control mechanism that controls pressure in the control chamber, the movable body being connected with the swash plate through a connecting mechanism and pulling the swash plate to increase the inclination angle of the swash plate with an increase of the pressure in the control chamber, wherein the swash plate has a top dead center portion that permits one of the pistons to be located at the top dead center, the connecting mechanism includes:

a first arm that is disposed on one side of an imaginary plane defined to extend passing through the top dead center portion and the axis of rotation and extends from the movable body toward the swash plate;

a second arm that is disposed on the other side of the imaginary plane and extends from the movable body toward the swash plate;

a traction portion that extends from the swash plate toward the movable body and is disposed between the first arm and the second arm; and a link pin that connects the traction portion to the first arm and the second arm, the first arm has a first guide surface that faces away from the swash plate and is in contact with the link pin, and a first facing portion that faces a first end of the link pin, the second arm has a second guide surface that faces away from the swash plate and is in contact with the link pin, and a second facing portion that faces a second end of the link pin, and the first arm and the second arm have a first opening and a second opening, respectively, that are open in a direction opposite to a direction in which the link pin moves on the first guide surface and the second guide surface with an increase of the inclination angle of the swash plate.

2. The variable displacement type swash plate compressor according to claim 1, wherein the first opening and the second opening are formed so that the link pin is allowed to enter thereinto.

3. The variable displacement type swash plate compressor according to claim 1, wherein the first arm and the second arm have a third opening and a fourth opening, respectively, that are open in the moving direction of the link pin so that the link pin is allowed to enter thereinto.

4. The variable displacement type swash plate compressor according to claim 1, wherein the first arm and the second arm have the first opening and the second opening, respectively, that are open in the moving direction of the link pin, the first facing portion has a projection that covers a part of the first end of the link pin as viewed in the direction opposite to the moving direction of the link pin, and the second facing portion has a projection that covers a part of the second end of the link pin as viewed in the direction opposite to the moving direction of the link pin.

5. The variable displacement type swash plate compressor according to claim 1, wherein the first facing portion has a slanted portion from which a part of the first end of the link pin is exposed when the inclination angle of the swash plate is minimum, and the second facing portion has a slanted portion from which a part of the second end of the link pin is exposed when the inclination angle of the swash plate is minimum.

* * * * *